United States Patent [19]

Pitcher

[11] 4,400,686

[45] Aug. 23, 1983

[54] VARIABLE ELECTRICAL RESISTANCE DEVICE

[75] Inventor: Arnold Pitcher, Romford, England

[73] Assignee: Colvern Limited, Essex, England

[21] Appl. No.: 285,693

[22] Filed: Jul. 21, 1981

[51] Int. Cl.[3] ..... H01C 1/02

[52] U.S. Cl. ..... 338/184; 338/197; 338/199

[58] Field of Search ..... 338/184, 197, 164, 199, 338/315, 67, 98

[56] References Cited

U.S. PATENT DOCUMENTS

| | | | |
|---|---|---|---|
| Re. 19,605 | 6/1935 | Flanzer et al. | 338/164 X |
| 2,781,436 | 2/1957 | Barden | 338/184 X |
| 3,902,152 | 8/1975 | Van Benthuysen | 338/197 X |

FOREIGN PATENT DOCUMENTS

| | | | |
|---|---|---|---|
| 658277 | 1/1929 | United Kingdom | 338/197 |

*Primary Examiner*—C. L. Albritton

*Attorney, Agent, or Firm*—Pollock, Vande Sande & Priddy

[57] ABSTRACT

A rotary variable electrical resistance device comprises a housing; a spindle, arranged for rotation in the housing to adjust the setting of the device, and arranged to be rigidly secured to the end of a rotatably supported shaft serving as an extension of the spindle or whose angular rotation is to be monitored by the device and such that the shaft effectively supports the resistance device. The housing is restrained from rotation by a member such as a pin on a disc secured to a support by a ring shaped member and engaging an opening or recess in a flange secured to the housing. Clearance between the members allows the device to be displaced to follow displacement of the shaft resulting from play in bearings supporting the shaft or misalignment or bending of the shaft and obviates the necessity for the expensive and bulky flexible couplings of the prior art.

15 Claims, 4 Drawing Figures

VARIABLE ELECTRICAL RESISTANCE DEVICE

FIELD OF THE INVENTION

This invention relates to a rotary variable electrical resistance device and more particularly to a variable resistance device having a rotatable operating spindle adapted to be secured to a rotatable shaft whose angular rotation is to be followed by the variable resistance device, the device having a novel means of mounting and location with respect to a support such that it is able to accommodate misalignment or bending of the shaft or a degree of axial and radial play in the shaft.

BACKGROUND TO THE INVENTION

Rotary variable electrical resistance devices, eg. potentiometers, are well known in the art. Such a device typically comprises a housing containing an arcuate element of electrical resistance material adapted to be traversed by a wiper of electrically conductive material, the wiper being operated by a rotatable spindle which is supported on bearings in the housing. Adjustment of the setting of the device is effected by rotating part of the spindle which protrudes from the housing. It has hitherto been common practice to mount a variable resistance device with its housing rigidly secured to a support which may, for example, be a rigid plate having a hole through which the operating spindle of the device passes.

It is sometimes required to couple the spindle of a variable resistance device to an operating shaft in order to provide an extension to the spindle or to monitor the degree of rotation of such a shaft. Problems exist in accurately aligning the shaft and spindle and also the shaft may not be absolutely straight. The shaft may also be mounted in such a way that it can exhibit a significant degree of axial and radial play. If a solid coupling is used between the shaft and spindle with any of these conditions existing, then the bearings of the spindle in the housing of the device may be subjected to excessive forces, resulting in damage to the device. Variations in torque in the shaft/spindle assembly may also occur during rotation in these conditions.

It has previously been proposed to deal with this problem by coupling the shaft and the spindle of the device by means of a flexible coupling member. Such a flexible coupling is expensive and often bulky to the extent that insufficient space is available for it to be used in some applications.

SUMMARY OF THE INVENTION

The present invention provides a rotary variable electrical resistance device comprising: a housing; a spindle secured in and arranged for rotation in said housing and adapted to adjust the setting of said device by causing a wiper of electrically conductive material to traverse an electrical resistance element supported on or in said housing, said spindle being adapted to be substantially rigidly secured to the end of a rotatably supported shaft, on a common axis with said shaft, whereby said spindle is rotatable with said shaft and such that said shaft substantially supports said device; means cooperating between said housing and a support to restrain said housing from rotation about the axis of said spindle when said spindle is caused to be rotated by said shaft, said means also being arranged such that said device is displaceable to follow longitudinal and/or lateral displacement of said end of said shaft.

In one embodiment, said means cooperating between said housing and support comprises a rigid member having a portion thereof adapted to be secured to said support and a further portion adapted to engage a recess or opening in said housing or in a part secured to or extending from said housing. In a modification of this embodiment, said means cooperating between said housing and support comprises a rigid member having a portion thereof adapted to be secured to said housing rather than said support and a further portion adapted to engage a recess or opening in said support rather than in said housing or in a part secured to or extending from said support. Backlash resulting from clearance between said member and said recess or opening may be avoided or minimized by providing one or more springs or other suitably resilient material between said member and said housing or said support or said part secured thereto.

Preferably said rigid member comprises a pin or bolt. The said pin or bolt may have a head for engaging said recess or opening; said pin or bolt or said head may be radiused to produce a substantially barrel-shape whereby variations in the angle at which said pin or bolt enters said recess or opening can be accommodated without said pin, bolt or head becoming jammed in said recess or opening.

The said part secured to or extending from said housing or said support suitably comprises a lug, flange, plate or disc having a hole or a recess therein for accommodating said rigid member.

One or more further lugs or flanges may be provided secured to or extending from said housing and each provided with a hole therein through which a screw or bolt with a head may be passed and secured to said support, said head of said screw or bolt being arranged to be clear of said lug or flange to permit displacement of said device to follow said longitudinal displacement of said end of said shaft, while providing a limitation for this displacement of the device.

In a modification of the above arrangement, the plurality of lugs or flanges may be replaced by a single plate, secured to and extending from said device and provided with holes or recesses for accommodating said screws, bolts or pins.

In an alternative embodiment, said means cooperating between said housing and support may comprise a spring blade having one end secured to said support and the other end secured to said housing, said spring blade being deflectable to permit said device to be displaced to follow lateral displacement of said end of said shaft. Said one or said other end of said spring blade may optionally be slideably secured to said support or said housing respectively, eg. by location in a slot or groove in said support or said housing, to permit said device to be displaced to follow longitudinal displacement of said end of said shaft.

In a further embodiment, said means cooperating between said housing and support may comprise a band encircling and spaced from said housing and secured to said support, a suitably resilient material being provided between said band and said housing to permit displacement of said device to follow said displacement of said shaft.

The said band may comprise a metal or plastics material; said resilient material suitably comprises a rubber, eg. silicone rubber.

In a still further embodiment, the means cooperating between the housing and support comprises a pin extending from a disc-shaped member adapted to be clamped at its periphery to said support by means of a ring-shaped member, said pin being arranged for location in an aperture provided in a flange member secured to the housing of the resistance device concentrically with said spindle, said disc shaped member and said support having an opening therein through which said spindle may pass, said flange member being shaped for location within said ring shaped member such that clearance is provided between said flange member and said ring shaped member to permit said device to be displaced to follow said longitudinal and/or lateral displacement of said end of said shaft, the location of said pin in said aperture in said flange member serving to restrain said housing from rotation about said axis of said spindle.

In a modification of this still further embodiment, instead of said pin being provided on the disc shaped member it may be provided extending from the flange member and arranged to be located either in an aperture provided in the disc shaped member or, if the disc shaped member is eliminated, in an aperture provided in said support.

Suitably said ring shaped member is secured to said support by means of screws or bolts.

BRIEF DESCRIPTION OF DRAWINGS

The invention is now described by way of example with reference to the accompanying drawings in which.

DETAILED DESCRIPTION OF PREFERRED EMBODIMENTS

Figure 1:
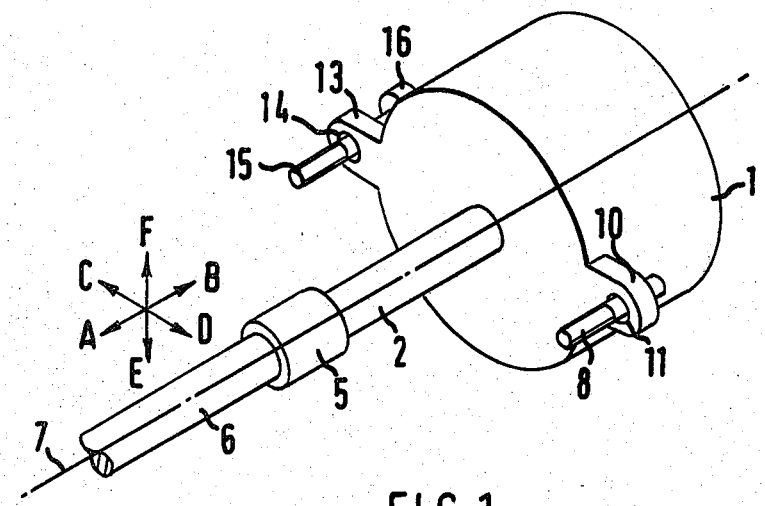
FIG. 1 shows a perspective view of an embodiment of a rotary variable resistance device according to the invention.
Figure 2:
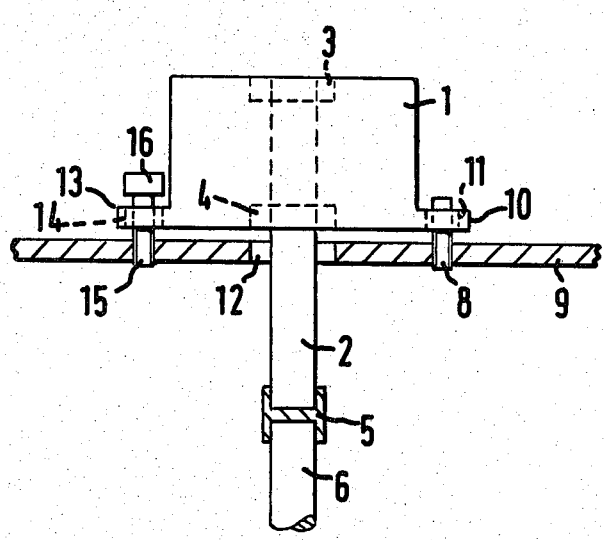
FIG. 2 shows a section through the embodiment of FIG. 1.

Referring to FIGS. 1 and 2, a rotary variable electrical resistance device, eg. a potentiometer, is constructed comprising a housing 1 of metal or rigid plastics material containing an arcuate element of electrical resistance material (not shown) adapted to be traversed by a wiper of electrically conductive material (not shown), the wiper being operated by a rotatable spindle 2 arranged for rotation in bearings 3 and 4 in the housing 1, to adjust the setting of the device. Such an arrangement of a housing, arcuate element, wiper and spindle is very well known in variable resistance device technology. The spindle 2 is rigidly secured, by means of a solid coupling 5, to the end of a rotatably supported shaft 6 whose angular rotation is to be followed by the variable resistance device. Shaft 6 may comprise, for example, a throttle control shaft of an internal combustion engine in a motor vehicle, the setting of the variable resistance device being required to be changed by rotation of the throttle control shaft, for effecting control functions in the operation of the engine. The coupled spindle 2 and shaft 6 have a common axis 7. The shaft 6 supports the variable resistance device.

In order to allow the setting of the device to be altered as shaft 6 is rotated, it is necessary to provide means to prevent rotation of the housing 1. A rigid member in the form of a pin 8 is secured at one end into a fixed support 9 which suitably comprises a metal plate or bracket. The end of the pin 8 is suitably threaded and engages a similarly threaded hole in the support 9. The housing 1 of the variable resistance device is provided with a lug or flange 10 extending therefrom and having a hole 11 through it. The variable resistance device is arranged such that the spindle 2 passes through a hole 12 provided in the support 9 and such that the pin 8 locates in the hole 11 in the lug or flange 10. The pin 8, located in hole 11, restrains the housing 1 from rotating about the axis of the spindle 2 when the spindle 2 is rotated by shaft 6. This simple arrangement is advantageous since it allows the variable resistance device to be displaced to follow any longitudinal displacement (i.e. in the direction indicated by arrows A, B) or lateral displacement (i.e. in the direction indicated by arrows C, D and E, F) of the end of shaft 6 which is coupled to the spindle 2, such displacement of the shaft taking place as a result of play in bearings which support it. The arrangement also allows the variable resistance device to tilt to accommodate a situation where the shaft 6 is not perpendicular to the support 9, or as a result of the shaft 6 being bent.

In order to avoid backlash resulting from clearance between the pin 8 and the sides of the holes 11 a suitably resilient material such as a spring or rubber (eg. silicone rubber) can be applied between the pin and sides of the hole to take up the clearance while permitting the necessary displacement to occur.

Although the pin 8 is shown in FIGS. 1 and 2 as having parallel sides, it may be advantageous for the pin to be formed of a barrel shape, thereby minimizing risk of the pin jamming in the hole 11 when the housing 1 of the device is caused to be tilted.

One or more further lugs or flanges 13, similar to lug or flange 10 may be provided, having a hole 14 therein. Such lugs or flanges 10, 13 are often already provided during manufacture of the device and hitherto intended for use in rigidly securing the device to a support. A screw 15 with a head 16 is passed through hole 14 in lug 13 and screwed into a hole provided in support 9. The head 16 of the screw 15 is arranged to be sufficiently clear of the lug 13 to permit the required degree of displacement of the device, while serving to prevent the spindle 2 from becoming decoupled from the shaft 6, e.g., in the event of the arrangement being utilized in conditions of severe vibration. It would be preferable to provide at least two further lugs 13 with screws 15, for this purpose.

Instead of using a plain pin 8, a pin with a head may be substituted, the head engaging the hole 11 in lug 10. Preferably the head of the pin is radiused to provide a barrel shape to prevent the head jamming in the hole when the housing 1 is caused to be tilted.

It may be necessary, for some applications, to preset the variable resistance device to allow a particular phasing between the device and the shaft coupled thereto. This may be achieved by providing a slot in the support 9 and providing one or more lock nuts on the end of the pin 8. Thus, with the lock nuts slack, the housing 1 of the device is rotated, the pin 8 being moved in the slot in support 9 during this rotation. When a desired setting of the device is attained, the pin is locked in place in the support 9 by means of the lock nuts.

Alternatively, the housing 1 of the device can be mounted on a sub-plate such that it can be rotated to a required position on the sub-plate and then clamped, a hole or recess being provided in the sub-plate into which pin 8 locates, operation being otherwise the same as described with reference to FIGS. 1 and 2.

It will be apparent to those skilled in the art to which this invention relates that a number of alternative embodiments can be envisaged which fall within the scope of the invention.

For example, instead of the rigid pin 8 being secured to support 9 and located in the hole 11 in the lug or flange 10, the pin 8 could be secured to lug or flange 10 or directly to the face of the housing of the device and be arranged to be located in a hole provided in the support 9. Alternatively a disc or plate (not shown) could be clamped to the support 9 and provided with an aperture for location by the pin 8, thus obviating the need to provide an aperture in the support for this purpose. This arrangement also permits a predetermined orientation of the device with respect to the support to be achieved which is valuable for phasing purposes.

Also, instead of using the rigid pin 8 shown in FIGS. 1 and 2, a flat spring blade could be substituted which would be secured at one end to the support 9 and at the other end to the side of the housing 1, lug 10 being unnecessary in such an embodiment. This arrangement would permit lateral displacement of the end of shaft 6 to be accommodated, but in the case where longitudinal displacements of the shaft are also required to be accommodated, the end of the spring blade could be slideably secured in a slot or groove in the side of housing 1 or in the support 9.

In an alternative embodiment, instead of using a pin 8 and lug 10, a band of metal or plastics material could be provided encircling, but spaced from, the housing and secured to support 9, a suitably resilient material, such as silicone rubber, being provided between the band and housing to permit displacement of the device while restraining the housing from rotating about the axis of the spindle 2.

It is also envisaged, within the scope of the invention, that a plurality of variable resistance devices could be provided arranged in ganged form on a common spindle axis and each provided with the means restraining the housing from rotation while permitting displacement to follow displacement of a shaft coupled to a spindle at one end of the ganged assembly. If each of the ganged devices is provided with a lug or flange, as denoted by reference numeral 10 in FIGS. 1 and 2, then a single pin 8, extended to pass through the holes in the lugs of all the devices, could be used to allow displacement of the assembly when displacement of the end of the shaft coupled thereto occurs.

Figure 3:
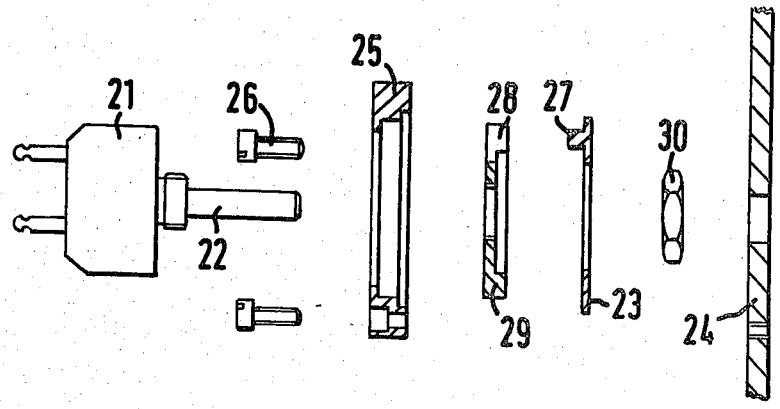
FIG. 3 shows a part-sectioned exploded view of an alternative embodiment of a rotary variable resistance device according to the invention.
Figure 4:
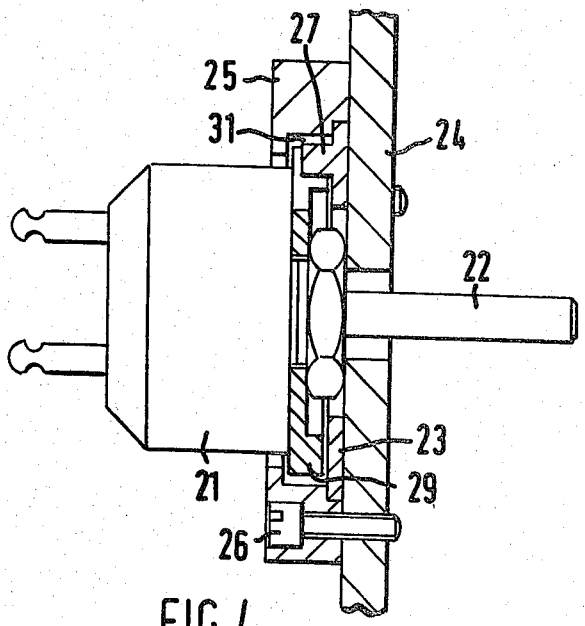
FIG. 4 shows an assembled view of the embodiment of FIG. 3.

A still further embodiment of the invention is illustrated in FIGS. 3 and 4.

A rotary variable electrical resistance device, e.g. a potentiometer, is constructed comprising a housing 21 of metal or rigid plastics material containing essential elements as previously described with reference to FIGS. 1 and 2. A rotatable spindle 22 extends from the housing for adjusting the setting of the device, spindle 22 being intended to be rigidly coupled to the end of a rotatably supported shaft (such as the shaft 6 shown in FIGS. 1 and 2) whose angular rotation is to be followed by the variable resistance device.

To permit the device 21, 22 to be displaced to accommodate any longitudinal and/or lateral displacement of a shaft to which the spindle is coupled and to restrain the housing 22 from rotation about the axis of the spindle 22 when the spindle is rotated, the following arrangement is employed. A disc shaped member 23 is arranged to be clamped at its periphery to a support 24 by means of a stepped ring shaped member 25, using screws 26 for securement of the member 25 to the support 24. A pin 27 extends from the disc shaped member 23 for location in an aperture 28 provided in a circular flange member 29 having a hole through its center secured to the housing 21 of the device, concentrically with the spindle 22, by means of nut 30. The disc shaped member 23 and support 24 each have a hole therein through which the spindle 22 may pass. The flange member 29 is shaped for location within the stepped ring shaped member 25 such that clearance is provided at region 31 between the flange member 29 and ring shaped member 25 to permit the device 21, 22 to be displaced to follow any longitudinal and/or lateral displacement of a shaft secured to the spindle 22. The pin 27, located in aperture 28 in the flange member 29, restrains the housing 21 from rotation about the axis of the spindle 22 when the latter is rotated.

In a modification of this further embodiment (not shown) instead of pin 27 being provided on the disc shaped member 23, it may be provided extending from the flange member 29 and arranged to be located in an aperture provided in the disc shaped member 23. With this arrangement, the disc shaped member 23 may be eliminated if desired and the pin located in an aperture provided in the support 24. In this latter case the ring shaped member 25 would be secured to the support 24 without the intermediary of the disc shaped member 23.

A further advantage of the present invention is particularly evident where a variable resistance device is operated in conditions where mechanical vibration exists. Where a device of the prior art is rigidly mounted and coupled to an operating shaft, such vibration sometimes results in what is known in the art as 'dither.' This involved the cyclic movement of the wiper of the device on the resistance track over a range of frequencies and relatively small angular amplitudes and can result in wear occurring on the track. With the present invention, a small amount of slackness or resilience in the coupling between the housing of the device and support advantageously attenuates the effect of such vibrations and reduces the effect of 'dither' wear on the resistance track.

I claim:

1. A rotary variable electrical resistance device comprising: a housing; a spindle secured in and arranged for rotation in said housing and adapted to adjust the setting of said device by causing a wiper of electrically conductive material to traverse an electrical resistance element supported by said housing, said spindle being adapted to be substantially rigidly secured to the end of a rotatably supported shaft, on a common axis with said shaft, whereby said spindle is rotatable with said shaft and such that said shaft substantially supports said device; means cooperating between said housing and a support to restrain said housing from rotation about the axis of said spindle when said spindle is caused to be rotated by said shaft, said means also being arranged such that said device is displaceable with respect to said support to follow longitudinal and/or lateral displacement of said end of said shaft when said shaft is rotated.

2. A device according to claim 1 in which said means cooperating between said housing and support comprises a rigid member having a portion thereof adapted to be secured to said support and a further portion adapted to engage an aperture defined by means appurtenant to said housing.

3. A device according to claim 1 in which said means cooperating between said housing and support comprises a rigid member having a portion thereof adapted to be secured to said housing and a further portion adapted to engage an aperture appurtenant to said support.

4. A device according to claim 2 in which backlash resulting from clearance between said member and said recess or opening is minimized by providing at least one resilient member between said rigid member and said aperture.

5. A device according to claim 2 in which said rigid member comprises a pin.

6. A device according to claim 5 in which said pin has a head for engaging said aperture.

7. A device according to claim 5 in which said pin or said head is radiused to produce a substantially barrel shape whereby variations in the angle at which said pin enters said aperture can be accommodated without said pin becoming jammed in said aperture.

8. A device according to claim 1 in which at least one lug is appurtenant to said housing and provided with a hole therein through which a threaded member may be passed and secured to said support, said threaded member having a head arranged to be clear of said lug to permit displacement of said device to follow said longitudinal displacement of said end of said shaft, while providing a limitation for this displacement of the device.

9. A device according to claim 4 in which said resilient member comprises a rubber.

10. A device according to claim 9 in which said rubber comprises silicone rubber.

11. A device according to claim 1 in which said means cooperating between the housing and support comprises a pin extending from a disc shaped member adapted to be clamped at its periphery to said support by means of a ring shaped member, said pin being arranged for location in an aperture provided in a flange member secured to the housing of the resistance device concentrically with said spindle, said disc shaped member and said support having an opening therein through which said spindle may pass, said flange member being shaped for location within said ring shaped member such that clearance is provided between said flange member and said ring shaped member to permit said device to be displaced to follow said longitudinal and/or lateral displacement of said end of said shaft, the location of said pin in said aperture in said flange member serving to restrain said housing from rotation about said axis of said spindle.

12. A device according to claim 11 in which said ring shaped member is secured to said support by means of threaded fasteners.

13. A device according to claim 1 in which a single plate is secured to and extends from said device, said plate being provided with a hole therein through which a threaded member may be passed and secured to said support, said threaded member having a head arranged to be clear of said plate to permit displacement of said device to follow said longitudinal displacement of said end of said shaft, while providing a limitation for this displacement of the device.

14. A device according to claim 1 in which said means cooperating between the housing and support comprises a disc-shaped member adapted to be clamped at its periphery to said support by means of a ring-shaped member, a flange member secured to the housing of the resistance device concentrically with said spindle, a pin extending from said flange member and arranged to be located in an aperture provided in said disc-shaped member, said disc-shaped member and said support having an opening therein through which said spindle may pass, said flange member being shaped for location within said ring-shaped member such that clearance is provided between said flange member and said ring-shaped member to permit said device to be displaced to follow said longitudinal and lateral displacement of said end of said shaft, the location of said pin in said aperture in said disc-shaped member serving to restrain said housing from rotation about said axis of said spindle.

15. A device according to claim 1 in which said means cooperating between the housing and support comprises a flange member secured to the housing of the resistance device concentrically with said spindle, a pin extending from said flange member and arranged to be located in an aperture provided in said support, said support having an opening therein through which said spindle may pass, said flange member being shaped for location within a ring-shaped member secured to said support such that clearance is provided between said flange member and said ring-shaped member to permit said device to be displaced to follow said longitudinal and lateral displacement of said end of said shaft, the location of said pin in said aperture in said support serving to restrain said housing from rotation about said axis of said spindle.

* * * * *